US006969814B2

(12) United States Patent
Yang

(10) Patent No.: US 6,969,814 B2
(45) Date of Patent: Nov. 29, 2005

(54) PUSH-BUTTON ARRANGEMENT FOR AN ELECTRIC TORCH

(75) Inventor: Man Ho Yang, Hong Kong (CN)

(73) Assignee: Creative Technology Hong Kong Ltd., Sheung Shui (HK)

( * ) Notice: Subject to any disclaimer, the term of this patent is extended or adjusted under 35 U.S.C. 154(b) by 0 days.

(21) Appl. No.: 10/476,515

(22) PCT Filed: Jan. 28, 2002

(86) PCT No.: PCT/IB02/00236

§ 371 (c)(1),
(2), (4) Date: Oct. 29, 2003

(87) PCT Pub. No.: WO03/016779

PCT Pub. Date: Feb. 27, 2003

(65) Prior Publication Data

US 2004/0120144 A1 Jun. 24, 2004

(30) Foreign Application Priority Data

Aug. 20, 2001 (DE) ..... 101 39 377

(51) Int. Cl.[7] ..... H01H 13/14
(52) U.S. Cl. ..... 200/341; 200/60
(58) Field of Search ..... 200/341, 60, 520, 200/302.2, 344, 345; 362/202, 205, 394

(56) References Cited

U.S. PATENT DOCUMENTS 3,924,116 A * 12/1975 Brindley ..... 200/302.1
3,950,627 A * 4/1976 Murata et al. ..... 200/530
4,152,564 A 5/1979 Wirz ..... 200/159
4,827,385 A 5/1989 Gammache ..... 362/206
4,956,755 A 9/1990 Maglica et al. ..... 362/206
5,043,854 A 8/1991 Gammache ..... 362/197
5,967,642 A * 10/1999 Chiu ..... 362/205
6,765,164 B2 * 7/2004 Lee et al. ..... 200/345

FOREIGN PATENT DOCUMENTS

CN 86207098 8/1987
CN 2255544 Y 6/1997
CN 1175784 3/1998

OTHER PUBLICATIONS

International Search Report in corresponding international patent application PCT/IS02/00236, mailed Nov. 7, 2002, citing above references A, B, and C (4 pages).

* cited by examiner

*Primary Examiner*—Lincoln Donovan
*Assistant Examiner*—M. Fishman
(74) *Attorney, Agent, or Firm*—Nash and Titus, LLC

(57) ABSTRACT

The invention relates to a push-button arrangement with a housing, a housing opening, a press switch element, a pushbutton facing out of the housing opening, and an elastically deformable hood or cap. The hood or cap has a hood edge which engages from the rear with the opening, and has an inner wall and an insertion ring. The insertion ring has an insertion height and an angular outer ring wall which can be adapted to the inner wall of the cap, and which can be completely received in the hood between the inner hood wall and the pushbutton, and which diameter can be elastically varied section by section along the height of the insertion ring.

6 Claims, 2 Drawing Sheets

PUSH-BUTTON ARRANGEMENT FOR AN ELECTRIC TORCH

BACKGROUND OF THE INVENTION

The invention relates to a pushbutton arrangement, especially for flashlights.

Pushbutton arrangements, especially for flashlights, are known in the state of the art. An elastically deformable hood or cap is inserted into a housing opening in the known flashlights. A pressure switching element with a pushbutton is located on the inside of the housing and the pushbutton can be actuated from outside of the flashlight housing via the hood. The pushbutton arrangements according to the state of the art have the disadvantage that the pushbuttons are designed as individual parts and after they have been inserted into the housing opening they can be readily removed again from the housing opening.

SUMMARY OF THE INVENTION

The present invention has the task of improving the known pushbutton arrangements.

This task is solved by a pushbutton arrangement with a housing, a housing opening, a pressure switching element, with a pushbutton facing out of the housing opening, with an elastically deformable hood or cap with a hood edge extending behind the housing opening and with a cylindrical inner wall, with an insertion ring, an insertion-ring height (elevation or level) and an outer ring wall that can fit against the inner wall of the hood and that can be completely received in the hood between the inner hood wall and the pushbutton and whose diameter can be elastically varied section by section (e.g. by sectors, or in stages) along the height of the insertion ring.

DETAILED DESCRIPTION OF THE PREFERRED EMBODIMENTS

Figure 3:
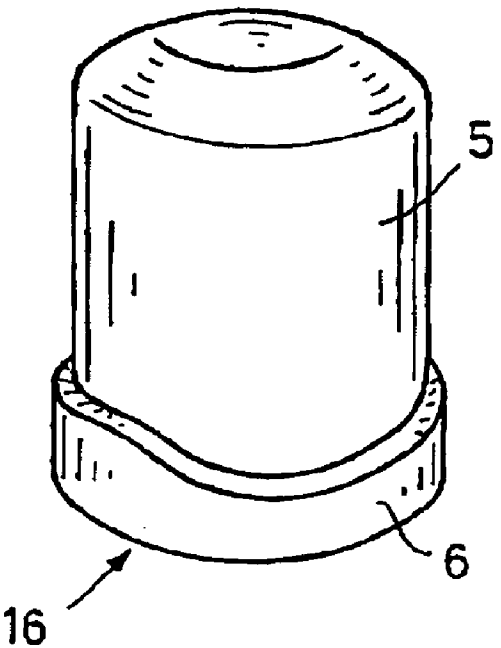
FIG. 3 shows the hood of the invention.

The pushbutton arrangement of the invention comprises an insertion ring that can be introduced into the hood or cap in such a manner that the outer ring wall rests on the inner hood wall. Basically, an only punctiform contact between the outer ring wall and the inner hood wall is also conceivable. The diameter of the insertion ring can be elastically varied section by section. The insertion ring of the invention makes it distinctly difficult to remove the elastically deformable hood out of the housing opening. During an attempt to remove the hood out of the housing opening the hood is grasped on its part projecting out of the housing and is pressed together. The elastically variable insertion ring yields under the pressure exerted on the hood and varies its diameter section by section.

The insertion ring preferably comprises an edge on the hood side and an edge on the hood-opening side and recesses emanating from the edge on the hood side and from the edge on the hood-opening side.

In this preferred embodiment the insertion ring is preferably designed in one piece of elastic plastic. The recesses make it possible to elastically vary the diameter of the insertion ring section by section along its ring height. The diameter of the edge on the side of the hood opening can be automatically enlarged by pressing together the edge on the hood side and the diameter reduction of the insertion ring associated with this edge in this section.

The recesses advantageously emanate in an alternating manner from the edge on the hood side and the edge on the hood-opening side in the direction of the particular other edge.

This especially advantageous embodiment of the invention also makes it possible to vary the diameter of the insertion ring section by section and has the particular effect that a reduction of the diameter of the edge on the hood side can result in an enlargement of the diameter of the edge on the hood-opening side. The insertion ring thus produces a clamping action between the housing opening and the edge on the hood-opening side and clamps the hood fast during the removal of the elastically deformable hood out of the housing opening by enlarging the diameter of the edge on the hood-opening side. This makes it distinctly difficult to remove the elastically deformable hood out of the housing opening.

The hood edge on the housing-opening side is preferably conformed to the profile of the inner housing wall in the area of the housing opening. In this preferred embodiment a rotating of the hood in the housing opening is rendered difficult.

The hood or cap preferably comprises a stop for the pushbutton on an inner wall facing away from the hood opening. The pushbutton is preferably not visible on the outside of the housing and can be actuated only via the hood. When a user pressed the hood in, he intends to actuate the pushbutton and to cut in or out therewith the pressure switching element, especially of a flashlight. The stop optimizes the transfer of force from the hood onto the pushbutton.

The stop is preferably designed as a short, solid cylinder whose outer stop wall runs concentrically to the cylindrical inner hood wall and a groove is arranged for receiving the hood-side edge between the outer stop wall and the cylindrical inner hood wall.

The inner hood wall preferably has a basically cylindrical design. The preferred embodiment cited makes it possible to receive the insertion ring in the hood interior in an especially advantageous manner.

The invention is described in the following in an exemplary embodiment with reference made to the figures.

Figure 1:
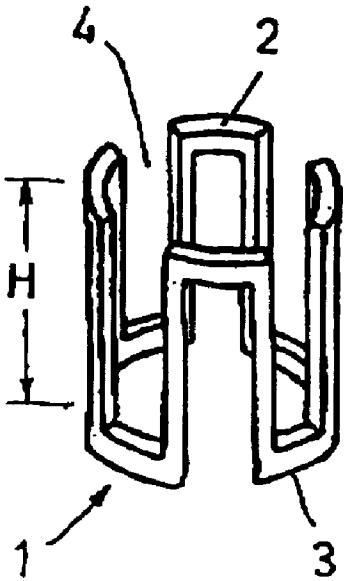
FIG. 1 shows an insertion ring in accordance with the invention in a normal position.

FIG. 1 shows insertion ring 1 comprising insertion-ring height H. Insertion ring 1 consist of a circumferential rectangular band formed in that recesses 4 emanate alternatingly from a hood-side edge 2 and a hood-opening side edge 3 in the direction of the particular other edge. Insertion ring 1 has a diameter that is constant along insertion-ring height H in its unexpanded normal position.

Figure 2:
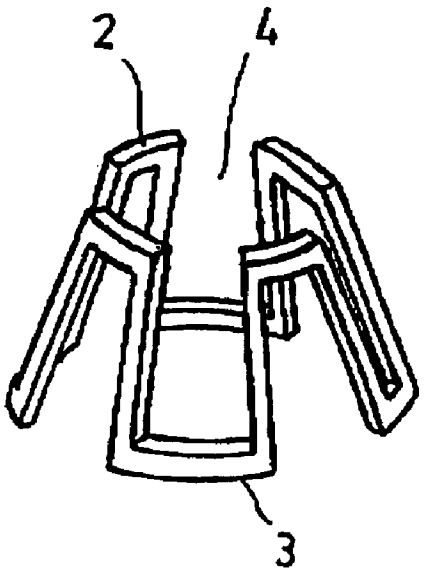
FIG. 2 shows the insertion ring in an expanded position.

FIG. 2 shows insertion ring 1 in accordance with FIG. 1 in an elastically deformed position. The ring diameter is varied or altered section by section along the height of the insertion ring in comparison to the ring diameter in the normal position. In the present figure edge 3 of insertion ring 1 on the hood-opening side has a greater diameter than insertion ring 1 in the normal position and hood-side edge 2 has a smaller diameter than the diameter of insertion ring 1 in the normal position.

FIG. 3 shows an outer view of hood 5. Insertion ring 1 is completely received in hood 5. Hood 5 has hood edge 6 that is adapted on the housing-opening side to the profile of an inner housing wall.

Figure 4:
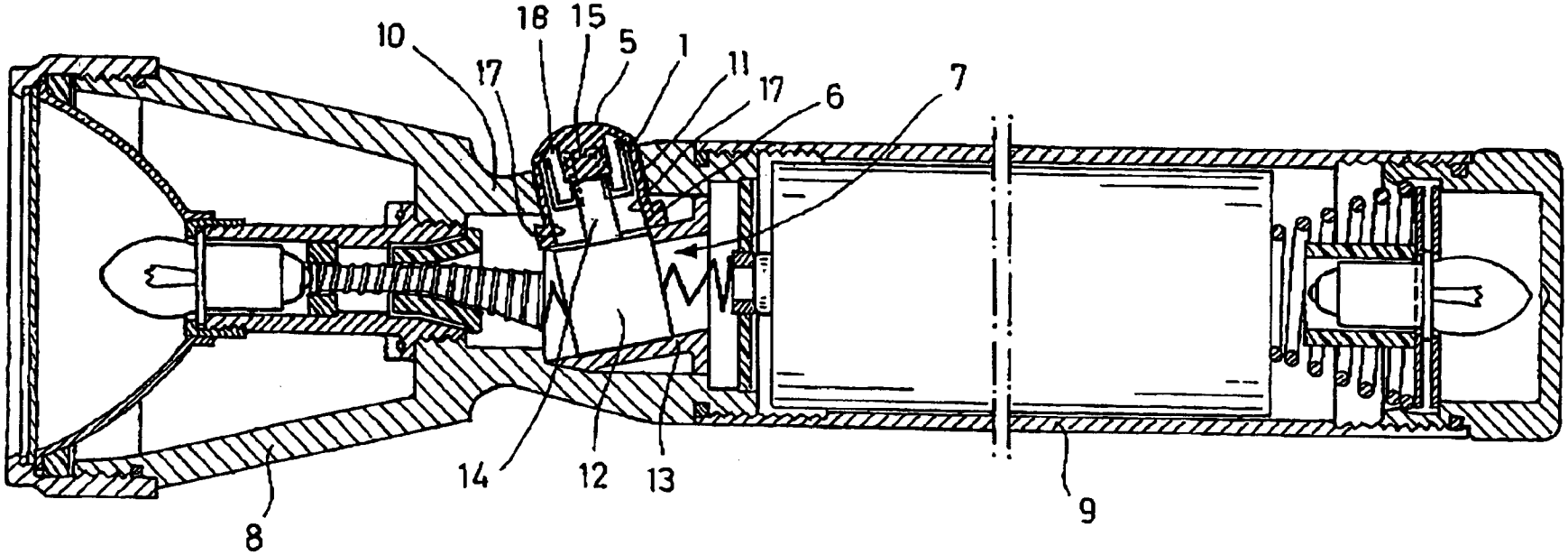
FIG. 4 shows a cross section of a flashlight with a pushbutton arrangement in accordance with the invention.

FIG. 4 shows pushbutton arrangement 7 of the invention built into a flashlight. Pushbutton arrangement 7 is arranged between flashlight head 8 and battery housing 9. Pushbutton arrangement 7 has a housing 10 with housing opening 11. Housing 10 is designed in the present instance as a transitional section between battery housing 9 and flashlight head 8. Pressure switching element 12 is arranged inside the flashlight. Pressure switching element 12 is firmly clamped in housing 13 for the pressure switching element and is fixed therewith in its position relative to the flashlight. Pushbutton 14 of pressure switching element 12 faces outward through housing opening 11 and extends partially through the housing opening. Hood 5 in accordance with FIG. 3 is inserted into housing opening 11 and an outer wall of the hood contacts housing opening 11 circumferentially thereby. Hood edge 6 extends behind housing opening 11. Hood 5 has an integrally formed stop 15 on an inner wall facing away from the hood opening. Stop 15 cooperates with pushbutton 14 and transfers the force acting from the outside onto pushbutton 14. Hood opening 16 is located on housing 13 of the pressure switching element. Stop 15 is designed as a short, solid cylinder. Its outer wall is formed concentrically to cylindrical inner hood wall 17. Groove 13 runs between the outer stop wall and cylindrical inner hood wall 17. Hood-side edge 2 of insertion ring 1 is received in groove 18.

Insertion ring 1 makes it difficult to loosen hood 5 out of housing opening 11. On the one hand, insertion ring 1 is less elastic than hood 5 and on the other hand, edge 3 of insertion ring 1, which edge is on the hood-opening side, is increased in its diameter by compression hood-side edge 2 of insertion ring 1. The increasing of the diameter of edge 3 of insertion ring 1, which edge is on the hood-opening side, results in a clamping action between housing opening 11 and insertion ring 1 as regards hood 5. During an attempt to pull hood 5 out of housing opening 11, hood-side edge 2 of insertion ring 1 is compressed and hood 5 held fast in housing 10 by the clamping action, as described above.

What is claimed is:

1. A pushbutton arrangement comprising a housing having a housing opening, a pressure switching element positioned within the housing, a pushbutton engageable with the pressure switching element within the housing, wherein said pushbutton has an elastically deformable hood extending out of the housing opening, wherein said elastically deformable hood has an inner hood wall, a hood opening and a hood edge, which hood edge engages the housing opening from inside the housing, and an insertion ring, wherein said insertion ring has an insertion ring height (H), a hood-side edge and a hood-opening-side edge wherein recesses emanate from the hood-side edge and from the hood-opening-side edge, and an outer ring wall which fits against the inner hood wall and which is receivable in the elastically deformable hood between the inner hood wall and the pushbutton, and wherein the diameter of the outer ring wall is elastically modifiable along the height (H) of the insertion ring.

2. The pushbutton arrangement according to claim 1, characterized in that the recesses emanate in an alternating manner from the hood-side edge and the hood-opening-side edge.

3. The pushbutton arrangement according to claim 2, characterized in that the recesses are rectangular and form a circumferential rectangular pattern in the insertion ring.

4. The pushbutton arrangement according to claim 1, characterized in that the housing has an inner housing wall and the housing opening hood edge engaging the housing opening is conformed to the profile of the inner housing wall in the area of the housing opening.

5. The pushbutton arrangement according to claim 1, characterized in that the elastically deformable hood comprises a stop for the pushbutton on the inner hood wall facing away from the hood opening.

6. The pushbutton arrangement according to claim 5, characterized in that the stop is a solid cylinder having an outer stop wall running concentrically to a cylindrical inner hood wall, and said stop has a groove for receiving the hood-side edge between the outer stop wall and the cylindrical inner hood wall.

* * * * *